United States Patent [19]

Köster et al.

[11] Patent Number: 4,968,178

[45] Date of Patent: Nov. 6, 1990

[54] DEVICE FOR BRIDGING EXPANSION JOINTS

[75] Inventors: Waldemar Köster, Rosrath-Forsbach, Fed. Rep. of Germany; Reinhold Huber, Bülach, Switzerland

[73] Assignee: Kober AG, Glarus, Switzerland

[21] Appl. No.: 391,520

[22] PCT Filed: Nov. 4, 1988

[86] PCT No.: PCT/EP88/01003

§ 371 Date: Jul. 21, 1989

§ 102(e) Date: Jul. 21, 1989

[87] PCT Pub. No.: WO89/04891

PCT Pub. Date: Jun. 1, 1989

[30] Foreign Application Priority Data

Nov. 4, 1988 [EP] European Pat. Off. ..... 88/01003
Nov. 24, 1988 [DE] Fed. Rep. of Germany ..... 3739717

[51] Int. Cl.[5] ..... E01C 11/02
[52] U.S. Cl. ..... 404/49; 52/396
[58] Field of Search ..... 404/47, 49, 53, 56, 404/64, 68; 52/396

[56] References Cited

U.S. PATENT DOCUMENTS

| | | | |
|---|---|---|---|
| 3,992,121 | 11/1976 | Geiger | 404/47 |
| 4,288,173 | 9/1981 | Nick | 404/49 |
| 4,423,979 | 1/1984 | Brown | 404/69 |
| 4,781,489 | 11/1988 | Buckenauer | 404/65 |

FOREIGN PATENT DOCUMENTS

| | | | |
|---|---|---|---|
| 2051110 | 4/1972 | Fed. Rep. of Germany | 404/68 |
| WO88/01003 | 11/1988 | PCT Int'l Appl. . | |
| WO89/04891 | 6/1989 | PCT Int'l Appl. . | |

*Primary Examiner*—William P. Neuder
*Attorney, Agent, or Firm*—Helfgott & Karas .

[57] ABSTRACT

A device for bridging over expansion joints of a roadway includes a matting of elastomeric substance placed over spaced elements of a joint to bridge the same. The matting has longitudinal portions held in grooves provided in retainer profiles positioned along the edge of each element of the joint. The longitudinal portions of the matting have ribs which fit into the grooves of the retainer profiles and fill the grooves so as to leave an anchoring space between the bottom of each groove and the ribs. The matting has holes which connect the upper surface of the matting with the anchoring space. The holes are filled with elastomeric synthetic resin casting which also fills the anchoring space.

6 Claims, 1 Drawing Sheet

DEVICE FOR BRIDGING EXPANSION JOINTS

BACKGROUND OF THE INVENTION

The present invention relates to a device for bridging expansion joints in road ways, with an extruded matting, made of elastomer, which bridges the joint, of the type wherein each longitudinal edge of the matting, parallel to the roadway is held in a groove formed in a retainer profile along the edge, the groove being open at the top, and wherein ribs formed in the matting fit precisely into the groove and essentially fill it completely, leaving only an anchoring space.

A device of this type is known from European Patent Application 86 277 B1. The known device has a matting with an extrudable cross-sectional shape. Each of its ribs, which project downward, fits into a groove in a retainer profile, which groove is open at the top. The retainer profile is anchored in the concrete substructure of the roadway. The matting completely covers the retainer profile, and by means of the side edges connects flush with the surface of the roadway. However, this connection is exposed to the direct drumming of the traffic rolling over it, which can lead to early fatigue of the elastomer of the matting and consequently to a tearing of the matting out of the anchoring. In addition, by virtue of their function, the ribs, which engage behind a sideways projection of the retainer profile, do not fill the grooves completely; this facilitates a deformation of the matting edge under the wheel load, the result being, once again, an early fatigue of the elastomer material.

SUMMARY OF THE INVENTION

It is an object of this invention to provide a structure of the edge connection for the elastomer matting, in a standard device, in such manner that cavities and local elongations in the connection area can be avoided, and so that despite simple manufacturing, a functionally secure and permanent connection between the matting edge and the roadway edge is guaranteed.

This and other objects of the present invention are attained by a device for bridging expansion joints in roadways, wherein the anchoring space enclosed between the ribs of the matting and the retainer profile is connected with the top surface of the matting through holes or slots forming casting channels in the matting, and the ribs are connected with the retainer profile by means of an elastomer synthetic resin casting substance that fills the casting channels and the anchoring space.

According to the invention, the retainer profile forms a closed anchoring space inside which the matting edge is held permanently and without bracing. The casting substance forms a firm, unbreakable connection between the matting edge and the retainer profile. It can be cast in the shop or right at the site.

Since the anchoring area is chambered by the retainer profile in known manner, a particularly durable connection is created, which is particularly resistant to the drumming exercised by the wheel loads.

Polyurethane is appropriate for the casting material; its hardness should be similar to that of the elastomer matting. During the casting, care should be taken that no cavities are left in the anchoring area; that is, the anchoring space existing between the retainer profile and the matting prior to the casting must be completely filled with elastomer casting resin.

In a preferred embodiment, the slots are formed by partitions between separated matting segments, that is, between central sections or a central section and an edge section of the matting. When the edge section is centrally symmetrical, it is possible to work with two extrusion forms, one for the central section and one for the two edge sections.

The central section of the matting, regardless of whether it is or is not connected with the edge sections, can have a cross-section of any shape, that is, the edge connection proposed in the invention is not limited to a combination with a specific type of matting.

In one-piece matting in particular, one useful embodiment provides for an insulating strip on the edge section.

In a preferred embodiment, the retainer profile is constructed as a C-profile, and the ribs have sideways catches that grip behind the profile ridges of the C-profile, which said ridges are directed inward.

The aforementioned objects, features and advantages of the invention will, in part, be pointed out with particularity, and will, in part, become obvious from the following more detailed description of the invention, taken in conjunction with the accompanying drawing, which form an integral art thereof.

BRIEF DESCRIPTION OF THE DRAWING

The single FIGURE of the drawing shows a vertical cross-section through a bridging device in the area of the edge connection of the matting.

DETAILED DESCRIPTION OF THE PREFERRED EMBODIMENT

Figure 1:
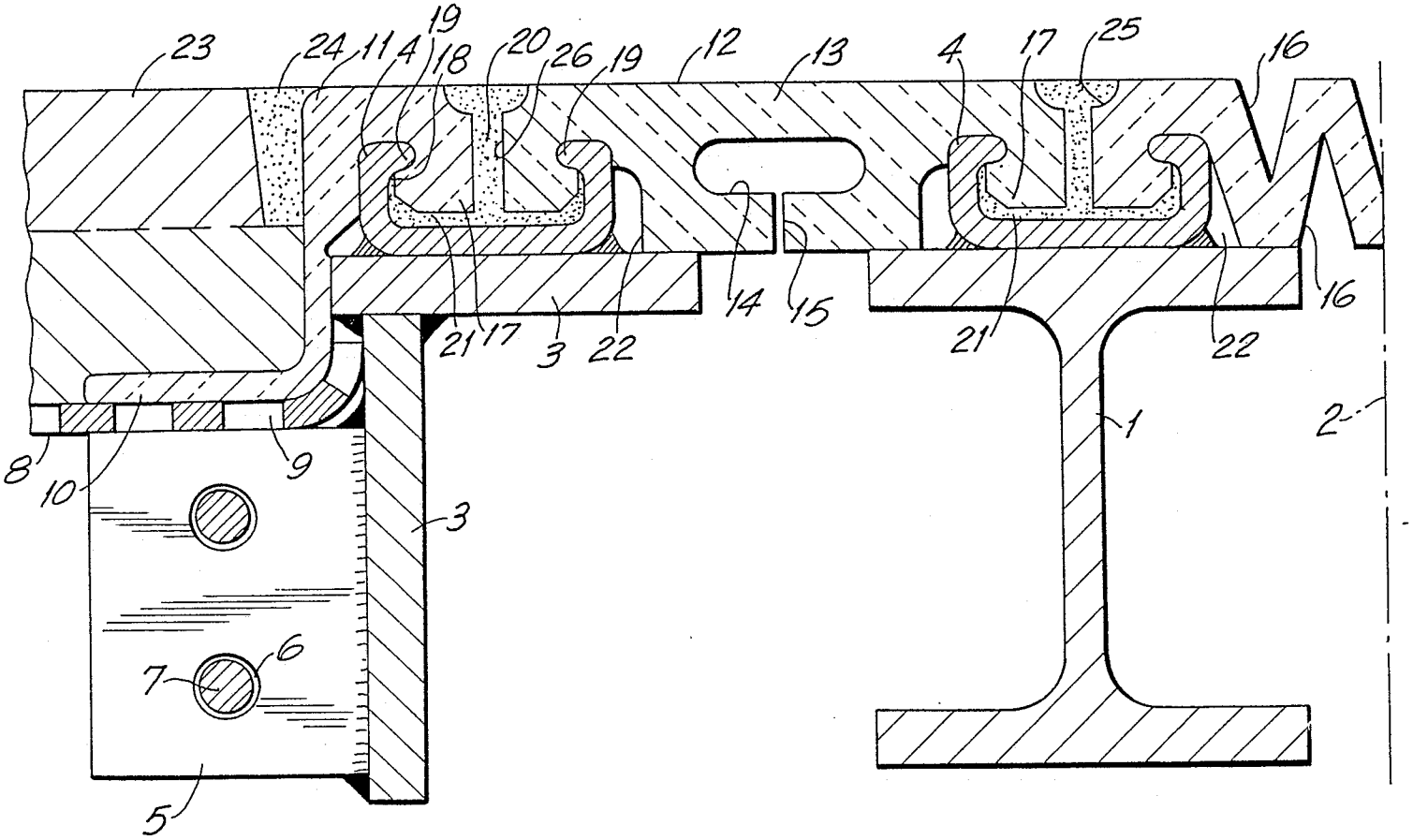

The drawing shows a bridging device in the example of an expansion joint with two central strips (1). The center of the joint is indicated by a vertical center line (2). A C-shaped retainer profile (4), with the opening at the top, is welded to each strip (1) and also to one L-shaped edge profile (3).

The edge profile (3) is permanently anchored in the concrete sub-structure of the edge of the roadway by means of plates (5) welded to the sides and by means of anchoring rods (7) run through openings (6) in the plates. Insulation (9), for example a sheet of plastic, is laid on the top surface (8) of the concrete sub-structure. Right on top of the insulation (9) there is an insulation connection (10) which is fashioned on an edge section (11) of the elastomer matting (12) that bridges the joint. The elastomer matting (12), which is for example rubber, is composed of a central section (13) and the two edge sections (11), of which only the left edge section (11) is illustrated. For the central section (13), any type of cross-sectional shapes that will accept the occurring expansions essentially without warping can be conceived. In the illustrated example, merely by way of example, two cross-sectional shapes are shown, namely, an embodiment with cavities (14) that are connected with the underside of the matting (12) by means of open slots (15), and an embodiment with triangles (16) cut out in alternating fashion in the top surface and the undersurface of the matting, the matting (12) being movable in the manner of a folding mechanism.

Ribs (17) fashioned on the matting edge section (11) on the one hand and on the central section (13) of the matting (12), on the other hand, engage on the inside of a retainer profile (4) for each section. The ribs (17) have side strips (18) that project toward the profile wall, by means of which said strips (18) the ribs engage behind profile ridges (19) of the C-shaped retainer profile (4), which profile ridges (19) face inward. This precision interlocking of strips (18) and profile ridges (19) facilitates the exact positioning of the matting segments for the subsequent casting. The casting substance (20) thereby formed fills the space between the matting sections (11, 13), on the one hand, and an anchoring space (21) remaining between the ribs (17) and the inner wall of the retainer profile (4) on the other hand. The result is an elastomer connection in the inner area of the retainer profile (4) that is not sensitive to the wheel loads rolling over it. Cavities (22) positioned only outside the retainer profile (4) and connected with it serve to neutralize deformations of the matting (12) crosswise to the roadway. These cavities (22) have no influence on the stability of the connection.

A gap between the side matting edge and a roadway surfacing (23) can similarly be cast with elastomer, age-hardenable synthetic resin, for example polyurethane, with formation of a sealing band (24). To facilitate the casting process, the facing edges of the edge section (11), on the one hand and the central section (13) of the matting (12), on the other hand, can be beveled or bowed out in relation to the top surface of the matting, so that a casting funnel (25) is created.

As already indicated, the space between the edge section (11) and the central section (13) of the matting (12) can be designed as a continuous slot (26) between separate matting sections (11, 13); however, slots (26) limited in the longitudinal direction of the roadway can also be provided, which would be suitably cut in a single-segment matting (12); similarly, instead of the slots (16) bores can be used, so that in the pouring process holes having the cross-sectional shape shown in the drawing are created.

We claim:

1. In a device for bridging expansion joints in roadways, comprising an extruded matting made of an elastomer substance and bridging spaced elements of a joint, said matting having longitudinal portions parallel to a roadway; and a plurality of retainer profiles each positioned along an edge of each element of the joint, each retainer profile having a groove open at the top thereof, each longitudinal portion of said matting being held in the groove of a respective retainer profile and being provided with ribs which fit precisely into the groove of the retainer profile and essentially fill the groove, leaving an anchoring space between a bottom of the groove and the ribs, the improvement comprising the matting having holes connecting the anchoring space with a top surface of the matting, said holes forming in the matting casting channels, the ribs being secured in each retainer profile by an elastomer synthetic resin casting substance which fills the casting channels and the anchoring space.

2. The device according to claim 1, wherein the matting includes separate matting sections, said holes being slots formed by separating lines between said separate matting sections.

3. The device according to claim 2, wherein said separate sections include at least one central section and edge sections of the matting.

4. The device according to claim 1, wherein each retainer profile is a C-shaped profile and has ridges facing inwardly of the profile, the ribs having side strips which engage behind the ridges of the S-shaped profile.

5. The device according to claim 1, wherein the elastomer casting substance has the hardness which is approximately equal to the hardness of the material of the matting.

6. The device according to claim 3, further comprising an insulated strip positioned on the edge section of the matting.

* * * * *

UNITED STATES PATENT AND TRADEMARK OFFICE

CERTIFICATE OF CORRECTION

PATENT NO. : 4,968,178

DATED : November 6, 1990

INVENTOR(S) : WALDEMAR KOSTER and REINHOLD HUBER

It is certified that error appears in the above-identified patent and that said Letters Patent is hereby corrected as shown below:

ON TITLE PAGE: line 30, correct the second priority to read as follows:

-- Nov. 24, 1987 [DE] Fed.Rep. of Germany....3739717 --

Signed and Sealed this

Thirty-first Day of March, 1992

*Attest:*

HARRY F. MANBECK, JR.

*Attesting Officer*

*Commissioner of Patents and Trademarks*